US006126898A

United States Patent [19]

Butler

[11] Patent Number: 6,126,898

[45] Date of Patent: Oct. 3, 2000

[54] CAST ALUMINIUM-COPPER ALLOY

[75] Inventor: Simon Andrew Butler, Chatham, United Kingdom

[73] Assignee: Aeromet International PLC, Rochester, United Kingdom

[21] Appl. No.: 09/262,446

[22] Filed: Mar. 4, 1999

[30] Foreign Application Priority Data

Mar. 5, 1998 [GB] United Kingdom ..... 9804599

[51] Int. Cl.[7] ..... C22C 21/12; C22C 21/08; C22C 21/06

[52] U.S. Cl. ..... 420/529; 420/531; 420/532; 420/533; 420/534; 420/535; 420/537; 420/538; 420/539

[58] Field of Search ..... 420/529, 539, 420/531, 532, 533, 534, 535, 537, 538

[56] References Cited

U.S. PATENT DOCUMENTS

| | | | |
|---|---|---|---|
| 3,544,761 | 12/1970 | Rosenberg | 219/137 |
| 4,916,030 | 4/1990 | Christodoulou et al. | 428/614 |
| 5,211,910 | 5/1993 | Pickens et al. | 420/532 |
| 5,462,712 | 10/1995 | Langan et al. | 420/528 |
| 5,523,050 | 6/1996 | Lloyd et al. | 420/528 |
| 5,630,889 | 5/1997 | Karabin | 148/417 |

FOREIGN PATENT DOCUMENTS

| | | | |
|---|---|---|---|
| 0 445 684 | 9/1991 | European Pat. Off. | C22C 21/00 |
| 040341537 | 4/1991 | Japan . | |
| 050140706 | 11/1991 | Japan . | |
| 090296245 | 4/1996 | Japan . | |
| 9-296245 | 4/1996 | Japan | C22C 21/12 |
| 2 259 308 | 3/1993 | United Kingdom | C22C 32/00 |
| 2 267 912 | 12/1993 | United Kingdom | C22C 21/12 |
| 2 288 189 | 10/1995 | United Kingdom | C22C 1/10 |
| WO 86/06366 | 11/1986 | WIPO | C04B 35/65 |
| WO 92/09711 | 6/1992 | WIPO | C22C 1/10 |
| WO 97/05296 | 2/1997 | WIPO | C22C 1/09 |

*Primary Examiner*—Daniel J. Jenkins
*Assistant Examiner*—Nicole Coy
*Attorney, Agent, or Firm*—Marshall, O'Toole, Gerstein, Murray & Borun

[57] ABSTRACT

An aluminum-copper alloy comprising substantially insoluble particles which occupy the interdendritic regions of the alloy.

17 Claims, 3 Drawing Sheets

FIG. 2
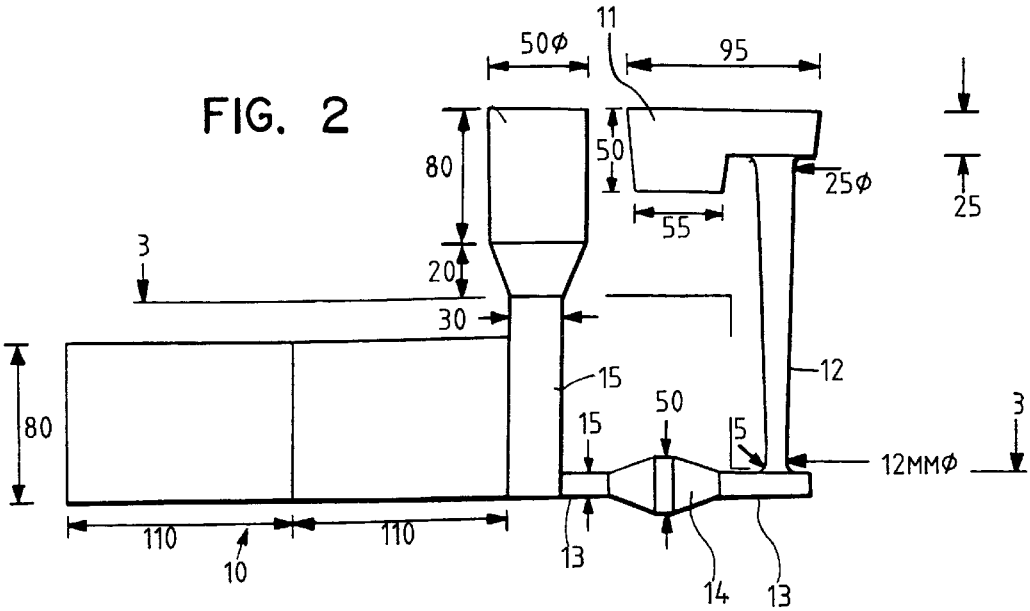
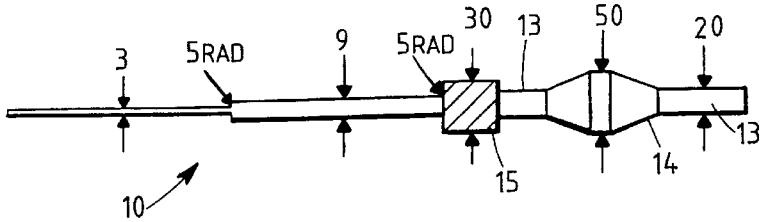
FIG. 3
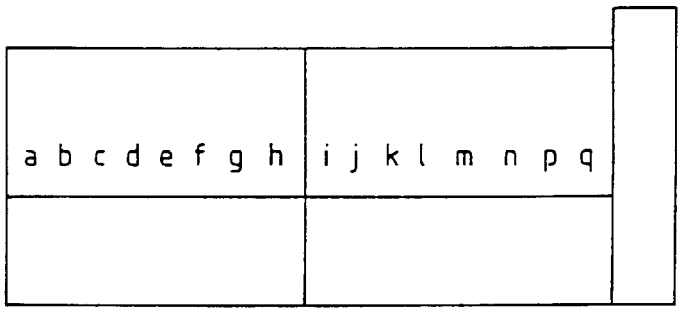
FIG. 4

CAST ALUMINIUM-COPPER ALLOY

DESCRIPTION OF INVENTION

This invention relates to cast aluminium-copper alloys. Aluminium-copper alloys have a potentially higher strength than other cast aluminium alloy systems such as aluminium silicon alloys. However, the use of aluminium-copper alloys for high performance applications has been limited due to their relatively poor castability compared to aluminium-silicon alloys.

SUMMARY OF THE INVENTION

An object of the invention is to provide an aluminium-copper alloy whereby the above mentioned problem is overcome or is reduced.

According to a first aspect of the invention we provide an aluminium-copper alloy comprising substantially insoluble particles which occupy the interdendritic regions of the alloy.

In said first aspect of the invention or according to a second aspect of the invention we provide an aluminium-copper alloy comprising:

| | |
|---|---|
| Cu | 3.0–6.0% |
| Mg | 0.0–1.5% |
| Ag | 0.0–1.5% |
| Mn | 0.0–0.8% |
| Fe | 0.0–0.5% |
| Si | 0.0–0.5% |
| Zn | 0.0–4.0% |
| Sb | 0.0–0.5% |
| Zr | 0.0–0.5% |
| Co | 0.0–0.5% |
| Insoluble particles | up to 20% |
| A1 and usual incidentals | Balance |

The insoluble particles may have a particle size which lies in the range 1–25 $\mu$m.

The particle size may lie in the range 1–15 $\mu$m or 1–5 $\mu$m

The insoluble particles may be present in the range 0.5% to 20%.

The alloy may comprise:

| | |
|---|---|
| Cu | 4.0–5.0% |
| Mg | 0.2–0.5% |
| Ag | 0.0–1.0% |
| Mn | 0.2–0.6% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble particles | up to 10% |

The alloy may comprise:

| | |
|---|---|
| Cu | 4.0–5.0% |
| Mg | 0.2–0.5% |
| Ag | 0.4–1.0% |
| Mn | 0.2–0.6% |
| Fe | 0.0–0.15% |
| Si | 0.0–0.15% |

-continued

| | |
|---|---|
| Zn | 0.0–1.8% |
| Sb | 0.0–0.5% |
| Zr | 0.0–0.5% |
| Co | 0.0–0.5% |
| Insoluble particles | up to 10% |

The insoluble particles may be present in the range 0.5% to 10%, or 1.5% to 9%, or 3% to 9%, or 5% to 9%.

The alloy may comprise:

| | |
|---|---|
| Cu | 4.2–5.0% |
| Mg | 0.2–0.5% |
| Ag | 0.0–0.85% |
| Mn | 0.25–0.4% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble Particles | 1.5–9.0% |
| A1 and usual incidentals | Balance |

The alloy may comprise:

| | |
|---|---|
| Cu | 4.2–5.0% |
| Mg | 0.2–0.5% |
| Ag | 0.0–0.85% |
| Mn | 0.25–0.4% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble Particles | 5.0–9.0% |
| A1 and usual incidentals | Balance |

The alloy may comprise:

| | |
|---|---|
| Cu | 4.2–5.0% |
| Mg | 0.2–0.5% |
| Ag | 0.45–0.85% |
| Mn | 0.25–0.4% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble Particles | 1.5–9.0% |

The alloy may comprise:

| | |
|---|---|
| Cu | 4.2–5.0% |
| Mg | 0.2–0.5% |
| Ag | 0.45–0.85% |
| Mn | 0.25–0.4% |
| Fe | 0.0–0.15% |
| Si | 0.0–0.15% |
| Zn | 0.0–1.8% |
| Sb | 0.0–0.5% |
| Zr | 0.0–0.5% |

-continued

| | |
|---|---|
| Co | 0.0–0.5% |
| Insoluble Particles | 5.0–9.0% |
| A1 and usual incidentals | Balance |

The insoluble particles may be of a size which is at least in the region of an order of magnitude smaller than the dendrite arm spacing of the solid alloy and occupy the interdendritic regions of the alloy The particles may comprise titanium diboride particles.

The alloy may comprise 0.5%–20% titanium diboride particles.

The alloy may comprise 0.5%–10% titanium diboride particles.

The alloy may comprise 3%–7% titanium diboride particles.

The alloy may comprise 7% titanium diboride particles.

Two major aspects that have been identified as factors which lead to variability of mechanical properties and structural integrity are the segregation of alloying elements and the formation of interdendritic porosity particularly that which is surface connected.

Research on cast aluminium copper alloys has indicated that a significant factor contributing to the variability of the material properties of such alloys is the flow of solute rich material through the interstices between the dendrite arm created during solidification.

In order to prevent this phenomena occurring additions of finely divided substantially insoluble particles have been made in accordance with the invention. It would normally be expected that the addition of such particles, which are normally hard and brittle, would result in an unacceptable reduction in the ductility of the alloy. However the research carried out has shown that good ductility is maintained as will be seen from the example set out below.

It will be appreciated that in the present invention the addition of finely divided substantially insoluble particles changes the solidification characteristics of the alloy and they are not applied as a direct hardening mechanism for the alloy.

Dispersed interdendritic porosity is also a characteristic of these alloys due to problems of feeding solidification shrinkage through the dendrite interstices. This type of porosity also causes a reduction in the mechanical properties of the material i.e. tensile strength and elongation.

According to a third aspect of the invention we provide a casting made from an alloy according to the first or second aspect of the invention.

BRIEF DESCRIPTION OF THE FIGURES

An example of the invention will now be described by way of example with reference to the accompanying drawings wherein:

FIG. 2 is a diagrammatic view of a "step plate casting" and also showing apparatus for making such a casting, and FIG. 3 is a section on the line 3—3 of FIG. 2 and FIG. 4 is a diagrammatic view of the step plate casting of FIGS. 2 and 3 showing the location of the test locations a–q.

DESCRIPTION OF THE PREFERRED EMBODIMENTS

Figure 1:
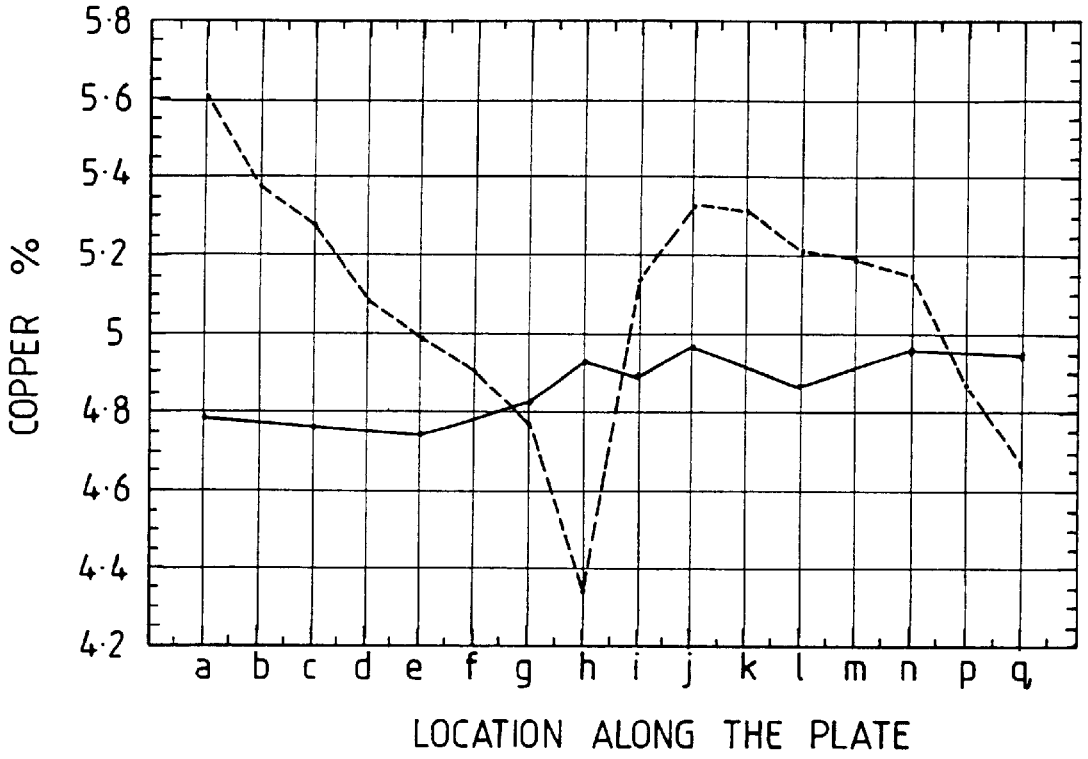
FIG. 1 is a graphic representation showing the variation of copper content along a "step plate casting" showing, in dotted line a conventional aluminium copper alloy and showing in solid line an alloy embodying the invention

Referring now to FIG. 1, a melt of a conventional aluminium-copper alloy having a composition comprising:

| | |
|---|---|
| Cu | 4.60% |
| Mg | 0.32% |
| Ag | 0.80% |
| Mn | 0.31% |
| Fe | 0.03% |
| Si | 0.04% |
| Zn | 0.01% |
| Sb | 0.01% |
| Zr | 0.01% |
| Co | 0.01% |
| $TiB_2$ | 0.00% |

was made in conventional manner.

The alloy was then cast, in conventional manner, into a ceramic investment shell mould. The mould had the configuration of a "step plate" i.e. the configuration shown in FIGS. 2 and 3. A step plate casting is indicated at 10 in FIGS. 2 and 3 and comprises two rectangular portions each 80 mm in wide by 110 mm long one of which has a thickness of 3 mm and the other of which has a thickness of 9 mm with a 5 mm radius on the corners of the shoulder therebetween. The test piece is made by pouring the alloy to be tested in to a pouring basin 11 from whence the metal passes to the test piece via a sprue 12 and a passage 13 containing a filter 14. A feeder 15 having a header volume 16 is provided for the test piece.

The resultant plate 10, on solidification, was then analysed, at points a–q, using a spark emission spectrometer and the resultant variation of copper along the step plate casting is shown in FIG. 1 by the dotted line. The points a–q are equally spaced along each plate portions.

An alloy of a similar composition comprising:

| | |
|---|---|
| Cu | 4.61% |
| Mg | 0.35% |
| Ag | 0.89% |
| Mn | 0.33% |
| Fe | 0.04% |
| Si | 0.05% |
| Zn | 0.01% |
| Sb | 0.01% |
| Zr | 0.01% |
| Co | 0.01% |
| $TiB_2$ | 7.00% |

was made in the same conventional manner.

As can be seen from the above composition this alloy, in accordance with the invention, contained 7% titanium diboride particles. These particles had a size lying in the range 1–15 microns. The alloy was then cast into a similar step plate casting mould in the same way as described above in connection with the conventional alloy. The resulting variation of copper content along the step plate casting was analysed in the same way and FIG. 1 shows, in full line, this variation in copper content.

It will be seen that the conventional alloy shows a gradual decrease in copper concentration along the plate until the 3 mm to 9 mm junction (location h–i) is reached.

In contrast the test plate made from the alloy embodying invention containing titanium diboride particles showed no tendency to behave in this way. The copper content varying from substantially 4.8% to a maximum of about 5.7% at the 3 mm to 9 mm junction.

A tensile test was then carried out on the two test pieces. The conventional test piece, not including any titanium diboride particles, produced the tensile test results which are shown in table 1.

TABLE 1

| Location | Copper % | Tensile Strength MPa | 0.2 Proof Stress MPa | Elongation % |
|---|---|---|---|---|
| a | 5.6 | 499 | 468 | 5.3 |
| h | 4.4 | 432 | 396 | 11.4 |

Similar tensile tests were carried out on the test piece embodying the invention and the tensile test results of this test piece are shown in Table 2.

TABLE 2

| Location | Copper % | Tensile Strength MPa | 0.2 Proof Stress MPa | Elongation % |
|---|---|---|---|---|
| a | 4.8 | 508 | 442 | 7.9 |
| h | 4.9 | 510 | 435 | 7.5 |

It can be seen by comparing Tables 1 and 2 that the addition of titanium diboride particles resulted in a significant increase of tensile strength, particularly at the h location. A decrease in the 0.2% proof stress at the a location and an increase at the h location and a substantially constant percentage elongation at the a and h locations compared with a reduced elongation at the a location and an increased elongation at the h location obtained with a conventional alloy.

The addition of hard particles such as titanium diboride in accordance with the invention to aluminium alloy normally results in a reduction of ductility. However it can be seen that good ductility i.e. percentage elongation, is maintained in the case of aluminium-copper alloy with the addition of such particles.

The tensile test results obtained in the solution only condition are set out below in Table 3.

TABLE 3

| Tensile Strength MPa | 0.2 Proof Stress MPa | Elongation % |
|---|---|---|
| 359 | 181 | 15.8 |
| 368 | 171 | 16.4 |

In addition internal and external porosity levels were determined to be extremely low when the test piece of Table 2 was examined in conventional manner by x-radiography and dye penetration techniques.

In the dye penetration technique the herebefore mentioned test piece portion having a thickness of 9 mm was submerged in a bath of a suitable liquid dye, in the present example, a fluorescent dye, for about 5 to 10 minutes to enable the dye to enter any porosity in the test piece which is connected to the surface of the test piece.

The test piece was then removed from the bath and washed and dried., in the present example in an oven at about 100° C. for about 5 to 10 minutes.

Figure 5A:
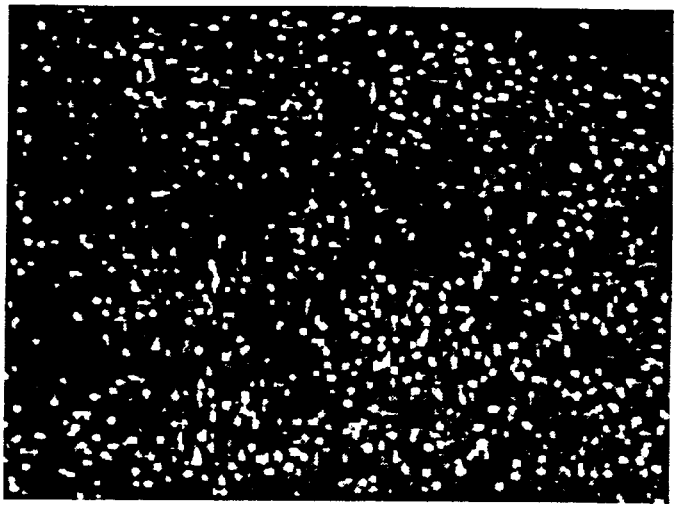
FIG. 5*a* and FIG. 5*b* are photographs of the 9 mm section of a step plate casting containing respectively 0% and 7% Ti $B_2$ particles as viewed during a dye penetrant test under ultraviolet light.
Figure 5B:
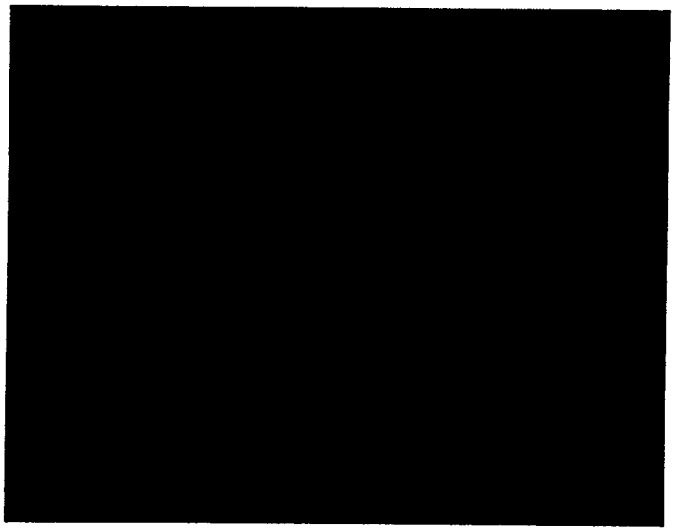

The test piece was then viewed in ultra-violet light to cause the dye to fluoresce and the photographs of FIGS. 5*a* and 5*b* were taken.

The test piece portion produced using the composition mentioned above without Ti $B_2$ particles had a considerable amount of surface connected porosity as can be seen from the light coloured areas of fluorescing die in FIG. 5*a*.

The test piece portion produced using the same composition but with Ti $B_2$ particles as described above has no discernible light coloured areas of fluorescent dye.

Thus, the dye penetrant examination shown in FIGS. 5*a* and 5*b* illustrates the effect of the presence of the particles described. It can be seen that the addition of particles has completely changed the solidification and structural characteristics leading to the elimination of surface indication of porosity.

In the example embodying the invention described above the dendrite arm spacing was found to lie in the range 40 to 200 $\mu$m and the titanium diboride particles had a size which lay in the range 1–15 $\mu$m and thus the particles were approximately an order of magnitude (i.e. 10 times) smaller than the dendrite arm spacing.

The spacing of the dendrite arms will depend upon various parameters such as the shape of the casting to be made and the rate of solidification which will vary with the size of the casting.

In this specification:

All compositions are expressed in percentage by weight:

In the phrase "insoluble particles", by "insoluble" we mean particles which are at least substantially insoluble in the alloy; by "particles" we mean particles of metal, or of inter-metallic compound or of ceramic material. The particles may comprise, for example, titanium diboride or silicon carbide, aluminium oxide, zirconium diboride, boron carbide or boron nitride:

Although only one specific alloy composition embodying the invention has been described above by way of example, an alloy embodying the invention may have an alloy composition, a particle composition, a particle size, a particle content etc. as described in any part of this specification.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. An aluminum-copper alloy comprising dendrite arms and interdendritic regions between said arms, and 0.5–20% of substantially insoluble particles which occupy the interdendritic regions of the alloy wherein said alloy comprises:

| | |
|---|---|
| Cu | 3.0–6.0% |
| Mg | 0.0–1.5% |
| Ag | 0.0–1.5% |
| Mn | 0.0–0.8% |
| Fe | 0.0–0.5% |
| Si | 0.0–0.5% |
| Zn | 0.0–4.0% |
| Sb | 0.0–0.5% |
| Zr | 0.0–0.5% |
| Co | 0.0–0.5% |
| Insoluble particles | 0.5–20% |
| Al and usual incidentals | balance. |

2. An alloy according to claim 1 wherein the insoluble particles have a particle size which lies in the range 1–25 $\mu$m.

3. An alloy according to claim 2 wherein the particle size lies in the range 1–15 μm or 1–5 μm.

4. An alloy according to claim 1 wherein the alloy comprises:

| | |
|---|---|
| Cu | 4.0–5.0% |
| Mg | 0.2–0.5% |
| Ag | 0.0–1.0% |
| Mn | 0.2–0.6% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble particles | [up to] 0.5–10% |
| A1 and usual incidentals | Balance. |

5. An alloy according to claim 1 wherein the alloy comprises:

| | |
|---|---|
| Cu | 4.0–5.0% |
| Mg | 0.2–0.5% |
| Ag | 0.4–1.0% |
| Mn | 0.2–0.6% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble particles | [up to] 0.5–10% |
| A1 and usual incidentals | Balance. |

6. An alloy according to claim 1 wherein the insoluble particles are present in the range 0.5% to 10%.

7. An alloy according to claim 1 wherein the alloy comprises:

| | |
|---|---|
| Cu | 4.2–5.0% |
| Mg | 0.2–0.5% |
| Ag | 0.0–0.85% |
| Mn | 0.25–0.4% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble Particles | 1.5–9.0% |
| A1 and usual incidentals | Balance. |

8. An alloy according to claim 1 wherein the alloy comprises:

| | |
|---|---|
| Cu | 4.2–5.0% |
| Mg | 0.2–0.5% |
| Ag | 0.0–0.85% |
| Mn | 0.25–0.4% |
| Fe | 0.0–0.15% |
| Si | 0.0–0.15% |

-continued

| | |
|---|---|
| Zn | 0.0–1.8% |
| Sb | 0.0–0.5% |
| Zr | 0.0–0.5% |
| Co | 0.0–0.5% |
| Insoluble Particles | 5.0–9.0% |
| A1 and usual incidentals | Balance. |

9. An alloy according to claim 1 wherein the alloy comprises:

| | |
|---|---|
| Cu | 4.2–5.0% |
| Mg | 0.2–0.5% |
| Ag | 0.45–0.85% |
| Mn | 0.25–0.4% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble Particles | 1.5–9.0% |
| A1 and usual incidentals | Balance. |

10. An alloy according to claim 1 wherein the alloy comprises:

| | |
|---|---|
| Cu | 4.2–5.0% |
| Mg | 0.2–0.5% |
| Ag | 0.45–0.85% |
| Mn | 0.25–0.4% |
| Fe | 0.0–0.15% |
| Si | 0.0–0.15% |
| Zn | 0.0–1.8% |
| Sb | 0.0–0.5% |
| Zr | 0.0–0.5% |
| Co | 0.0–0.5% |
| Insoluble Particles | 5.0–9.0% |
| A1 and usual incidentals | Balance. |

11. An alloy according to claim 1 wherein the insoluble particles are of a size which is at least in the region of an order of magnitude smaller than the dendrite arm spacing of the solid alloy.

12. An alloy according to claim 1 where the particles comprise titanium diboride particles.

13. An alloy according to claim 12 wherein the alloy comprises 0.5%–20% or 0.5%–10% titanium diboride particles.

14. An alloy according to claim 13 wherein the alloy comprises 3%–7% or 7% titanium diboride particles.

15. A casting when made from an alloy according to claim 1.

16. An alloy according to claim 1 wherein the insoluble particles are present in the range 3% to 9%.

17. An alloy according to claim 1 wherein insoluble particles are present in the range 5% to 9%.

* * * * *

UNITED STATES PATENT AND TRADEMARK OFFICE

CERTIFICATE OF CORRECTION

PATENT NO. : 6,126,898
DATED : October 3, 2000
INVENTOR(S) : Simon Andrew Butler It is certified that error appears in the above-identified patent and that said Letters Patent is hereby corrected as shown below:

Column 7, line 16, "[up to]" should be deleted.

Column 7, line 32, "[up to]" should be deleted.

Signed and Sealed this

Eighth Day of May, 2001

*Attest:*

Nicholas P. Godici

NICHOLAS P. GODICI

*Attesting Officer*

*Acting Director of the United States Patent and Trademark Office*